US010094532B2

(12) United States Patent
Houston

(10) Patent No.: US 10,094,532 B2
(45) Date of Patent: Oct. 9, 2018

(54) MULTIFUNCTIONAL LAMP SHADE ASSEMBLY

(71) Applicant: Michelle Houston, Leesburg, FL (US)

(72) Inventor: Michelle Houston, Leesburg, FL (US)

( * ) Notice: Subject to any disclaimer, the term of this patent is extended or adjusted under 35 U.S.C. 154(b) by 0 days.

(21) Appl. No.: 15/700,276

(22) Filed: Sep. 11, 2017

(65) Prior Publication Data

US 2018/0100630 A1 Apr. 12, 2018

Related U.S. Application Data

(60) Provisional application No. 62/405,632, filed on Oct. 7, 2016.

(51) Int. Cl.

| | |
|---|---|
| ***F21V 11/00*** | (2015.01) |
| ***F21V 1/16*** | (2018.01) |
| ***F21V 1/02*** | (2006.01) |
| ***F21V 23/04*** | (2006.01) |
| ***F21K 9/238*** | (2016.01) |
| ***F21L 4/00*** | (2006.01) |
| ***H05B 37/02*** | (2006.01) |
| ***F21S 6/00*** | (2006.01) |
| ***H05B 33/08*** | (2006.01) |
| ***H05B 35/00*** | (2006.01) |
| *F21W 131/30* | (2006.01) |
| *F21Y 109/00* | (2016.01) |
| *F21Y 113/20* | (2016.01) |
| *F21S 9/02* | (2006.01) |
| *F21Y 115/10* | (2016.01) |
| *F21Y 113/10* | (2016.01) |

(52) U.S. Cl.

CPC ..... *F21V 1/16* (2013.01); *F21K 9/238* (2016.08); *F21L 4/00* (2013.01); *F21S 6/003* (2013.01); *F21V 1/02* (2013.01); *F21V 23/0442* (2013.01); *F21V 23/0471* (2013.01); *H05B 33/0863* (2013.01); *H05B 35/00* (2013.01); *H05B 37/0272* (2013.01); *F21S 9/02* (2013.01); *F21S 9/022* (2013.01); *F21W 2131/30* (2013.01); *F21Y 2109/00* (2016.08); *F21Y 2113/10* (2016.08); *F21Y 2113/20* (2016.08); *F21Y 2115/10* (2016.08); *H05B 37/0281* (2013.01)

(58) Field of Classification Search

CPC ..... F21V 1/02; F21W 2131/30

See application file for complete search history.

(56) References Cited

U.S. PATENT DOCUMENTS

| | | | | |
|---|---|---|---|---|
| 4,809,145 | A | 2/1989 | Bennett | |
| 5,654,552 | A | 8/1997 | Toombs | |
| 5,975,725 | A | 11/1999 | Ireland-Stacy | |
| 8,388,186 | B2 | 3/2013 | Fu | |
| 9,347,633 | B1 | 5/2016 | Fitzwater | |
| 2003/0165062 | A1* | 9/2003 | Humphrey | F21V 1/06 362/352 |
| 2007/0263377 | A1 | 11/2007 | Butler | |

(Continued)

*Primary Examiner* — Evan Dzierzynski

(74) *Attorney, Agent, or Firm* — Mitchell J. Mehlman, Esq.

(57) ABSTRACT

An illuminated multifunctional lamp shade assembly including a frame, a finial, at least one light, a timer and a battery is provided. The assembly can be used for lighting in emergency circumstances, or in addition to, or instead of, standard lighting under non-emergency circumstances. The assembly can be portable such that it can be used in place on a lamp or removed and be used as an independent portable light source for a variety of applications.

13 Claims, 4 Drawing Sheets

(56) References Cited

U.S. PATENT DOCUMENTS

| | | | | |
|---|---|---|---|---|
| 2009/0073694 | A1* | 3/2009 | Scannell, Jr. | A47G 7/06 362/253 |
| 2012/0300470 | A1 | 11/2012 | Chang | |
| 2014/0247579 | A1 | 9/2014 | Hikmet | |
| 2015/0338077 | A1* | 11/2015 | Johnson | F21V 23/005 362/234 |
| 2016/0097517 | A1* | 4/2016 | Loehr | F21S 8/063 362/294 |

* cited by examiner

MULTIFUNCTIONAL LAMP SHADE ASSEMBLY

CROSS-REFERENCE TO RELATED APPLICATION

This application claims priority of U.S. Provisional Application Ser. No. 62/405,632, entitled "Multifunctional Lamp Shade Assembly", filed Oct. 7, 2016, the disclosure of which is incorporated herein by reference in its entirety.

BACKGROUND OF THE INVENTION

The invention is directed to an illuminated multifunctional lamp shade assembly. The assembly can be used to provide light in emergency circumstances, such as a power outage, or in addition to, or instead of, standard lighting under non-emergency circumstances. The lamp shade assembly can be configured to fit on a plurality of types of lamps and can replace existing shades to provide additional functionality, decoration, and utility to existing lamps. The invention can also be configured to be portable such that, once installed on a lamp, it can be used in place or removed and be used as an independent portable light source for a wide variety of applications and configurations.

Known devices include U.S. Pat. No. 9,347,633 ("Fitzwater") discloses a decorative cordless lamp having a replaceable rechargeable energy storage device (e.g. a battery) for powering an LED lighting element. The LED lighting element may be controlled by a variety of switches, timers, and sensors to enable the user to selectively tailor the operation of the decorative cordless lamp. The lamp utilizes wireless charging and a series of interchangeable bases.

U.S. Pat. No. 8,388,186 ("Fu") discloses a lamp shade including first and second interlocking shade sections. Each of the first and second interlocking shade sections is made of a plastic material and has a different color than the other section. The lamp shade also includes a bulb socket supported by the first interlocking shade section and at least partially surrounded by a plurality of ventilation holes. One of the first and second interlocking shade sections has an annular recess and a set of spaced fingers within the annular recess. The other of the first and second interlocking shade sections has a radially inwardly directed annular flange. The annular flange including a set of slots sufficient in number and sized so as to receive the fingers, whereby the fingers are received in and rotatable relative to the slots to interlock the first and second interlocking shade sections.

U.S. Pat. No. 5,975,725 ("Ireland-Stacy) discloses a shade for covering a light source and a process for making the shade. The shade comprises an inner member and an outer member where the outer member is connected to the inner member. At least one inclusion is located between the inner member and the outer member wherein covering the light source with the shade enables viewing of the inclusion therein when the light source is in an on state and substantially prohibits viewing of the inclusion therein when the light source is in an off state.

U.S. Pat. No. 5,654,552 ("Toombs") is directed to a lamp shade including a glow-in-the-dark region with a first side disposed toward a light source so that the light source illuminates the first side and with a second side disposed away from the light source. The glow-in-the-dark region includes a glow-in-the-dark substance that stores energy from illumination and that responds to the stored energy by emitting light in the visible range. A portion of the light emitted by the glow-in-the-dark substance exits from the second side.

U.S. Pat. No. 4,809,145 ("Bennett") is directed to a free-standing (self-supporting) lamp shade for controlling the illumination within a room without touching the light or its power source. This device includes the use of a shade which blocks the light emitted.

United States Pub. No. 20140247579 ("Hikmet") provides a lighting unit comprising a light source configured to provide a beam of light. The light source has light exit surface for escape of the light from the light source, a lamp shade partly surrounding the light source. The lamp shade has an internal lamp shade surface, a lamp shade light exit, and a light conversion element configured partly between the light exit surface of the light source and the lamp shade light exit of the lamp shade. The light conversion element comprises a light transmitting part including a luminescent material configured to convert at least part of the beam of light into luminescent material light.

United States Pub. No. 20120300470 ("Chang") discloses a shaped lamp shade of an LED lamp. The lamp shade is made of a translucent material matched with an LED lamp strip and a lamp holder and includes at least one strip-shaped optical refraction unit having an external refractive surface, an internal refractive surface corresponding to the external refractive surface, and an assembling structure for matching the lamp holder. The external refractive surface or internal refractive surface is a curved surface without an inflection point and the curved surface has a constant or gradually changing curvature; and a non-curved surface is formed on the other side.

United States Pub. No. 20070263377 ("Butler") provides a lamp shade and signage that glows in the dark after activation by incident electromagnetic radiation. Furthermore, a reflector is incorporated into the lamp shade and/or signage to effectively direct the electromagnet radiation emitted from the luminescent phosphor into an open space.

None of these known devices include the features and benefits of the instant invention. Therefore, there is an unfilled need for a multifunctional illuminated lamp shade assembly. The present invention is directed to improved illumination devices, and in particular, multifunctional lamp shade assemblies for use in a wide range of applications. Further, such assemblies can be used provide auxiliary lighting, security, or decoration without the need to access to a standard AC power source, such as 120V, 60 Hz alternating current.

SUMMARY OF THE INVENTION

In one aspect of the instant invention a multifunctional lamp shade assembly can include a frame. The frame can include an inner surface or covering and an outer surface or covering. A finial can be used for attaching said frame to a lamp base. At least one light can be disposed on the frame between the inner and outer surface. A timer for controlling the at least one light connected can be connected to the frame. A batter cane be connected to the frame forming and electrical circuit arrangement with the timer or the at least one light to provide power to the at least one light or timer or both. The timer can include a separate power source.

In one embodiment, a fabric cover can be disposed on the outer or inner surfaces.

In some embodiments, the assembly can include one or more motion sensors. The sensors can be configured to illuminate the at least one light when motion is detected.

In a particular embodiment, the one or more motion sensors can be optical or infrared sensors.

In some embodiments, a wireless transceiver transceiver can pairable with smart device, such as a smart phone or tablet. The smart device can include an application for controlling at least an illumination pattern, a brightness, or a color of the at least one light.

In certain embodiments, the at least one light can be a plurality of LED lights.

In some embodiments, the inner or outer frame cover can be translucent or transparent.

In some particular embodiments, the at least one light can be commanded to blink in a plurality of colors or a plurality of timed patterns.

In certain embodiments, the finial can be ring shaped. Other shapes that allow the finial to act as a handle to carry the assembly are contemplated.

In some embodiments, the shade assembly can include a lamp. The lamp may be any type of lamp that can accept a shape by attachment of the frame using a finial.

In another aspect of the invention, a lamp can include a bulb. A frame has an inner surface and an outer surface. A finial can attach the frame to the lamp. At least one light can be disposed on frame between said inner surface and the outer surface. A timer can be connected to the frame for setting an illumination or de-illumination schedule for the at least one light. A battery can be connected to the frame. The battery can be connected to form an electrical circuit with the timer and the at least one light to provide power thereto.

In some embodiments of this aspect, frame can include a fabric cover. The cover can be disposed on the outer or inner surface.

In certain embodiments, one or more motion sensors, can be configured to illuminate the assembly when motion is detected. The sensors can be attached to the lamp or the frame.

In a particular embodiment, the one or more motion sensors can be optical or infrared sensors.

In some embodiments, a wireless transceiver can be paired with smart device, for example using a wire protocol. The smart device can include an application for controlling an illumination pattern, a brightness, or a color of the at least one light.

In certain embodiments, the at least one light can be a plurality of LED lights.

In some embodiments, the frame cover can be translucent or transparent.

In other embodiments, the at least one light can be commanded to blink in a plurality of colors or a plurality of patterns.

In some embodiments, the finial can be ring shaped.

In another aspect of the invention, a lamp shade assembly can include a lamp having a bulb. A frame can include an inner surface and an outer surface where a cover can be disposed on the outer or the inner surface. A finial can attach the frame to the lamp. At least one light can be disposed on the frame between the inner surface and the outer surface. A timer can be connected to the frame. A battery can be connected to the frame such that the battery is connected in an electrical circuit with the timer and the at least one light to provide power as needed. One or more optical or infrared motion sensors can be connected to the frame and configured to illuminate the assembly when motion is detected. A wireless transceiver can be paired with a smart device. The smart device can include a software application for controlling an illumination pattern, a brightness, or a color of the at least one light.

In some embodiments, the shade assembly can be configured with internal or external lights. For example, one or more LED strips can be mounted between an inner surface and an outer surface of a translucent or transparent shade cover.

In one embodiment of the invention, the shade assembly can include a battery for operation of the lights when the lamp is switched off or there is no power available, such as during a power outage in an emergency such as a hurricane.

In some embodiments, a timer can be utilized to illuminate the shade assembly at specific times, for example, as a night-light or for home security. The times can be set such that the shade illuminates and de-illuminates according to a desired schedule.

In certain embodiments, the device can include an optical or infrared motion sensor to turn on the illumination, such as light bulbs or LEDs, when motion is detected.

In one particular embodiment, the shade can be removed from the lamp and carried to any location requiring illumination. The assembly can act as a lantern and can be utilized for both indoor or outdoor illumination.

Further, in some embodiments, the lights can be set to blink in a variety of colors or patterns, for example as a holiday decoration.

In certain embodiments, the lights can be connected to a standard plug, solar power device, or a USB port.

In some embodiments, a remote controller can be used turn on and off the battery power and for to change the light colors and sequence patterns.

The materials of the shade assembly can be colored, translucent, transparent, flexible, or rigid.

DESCRIPTION

Figure 1:
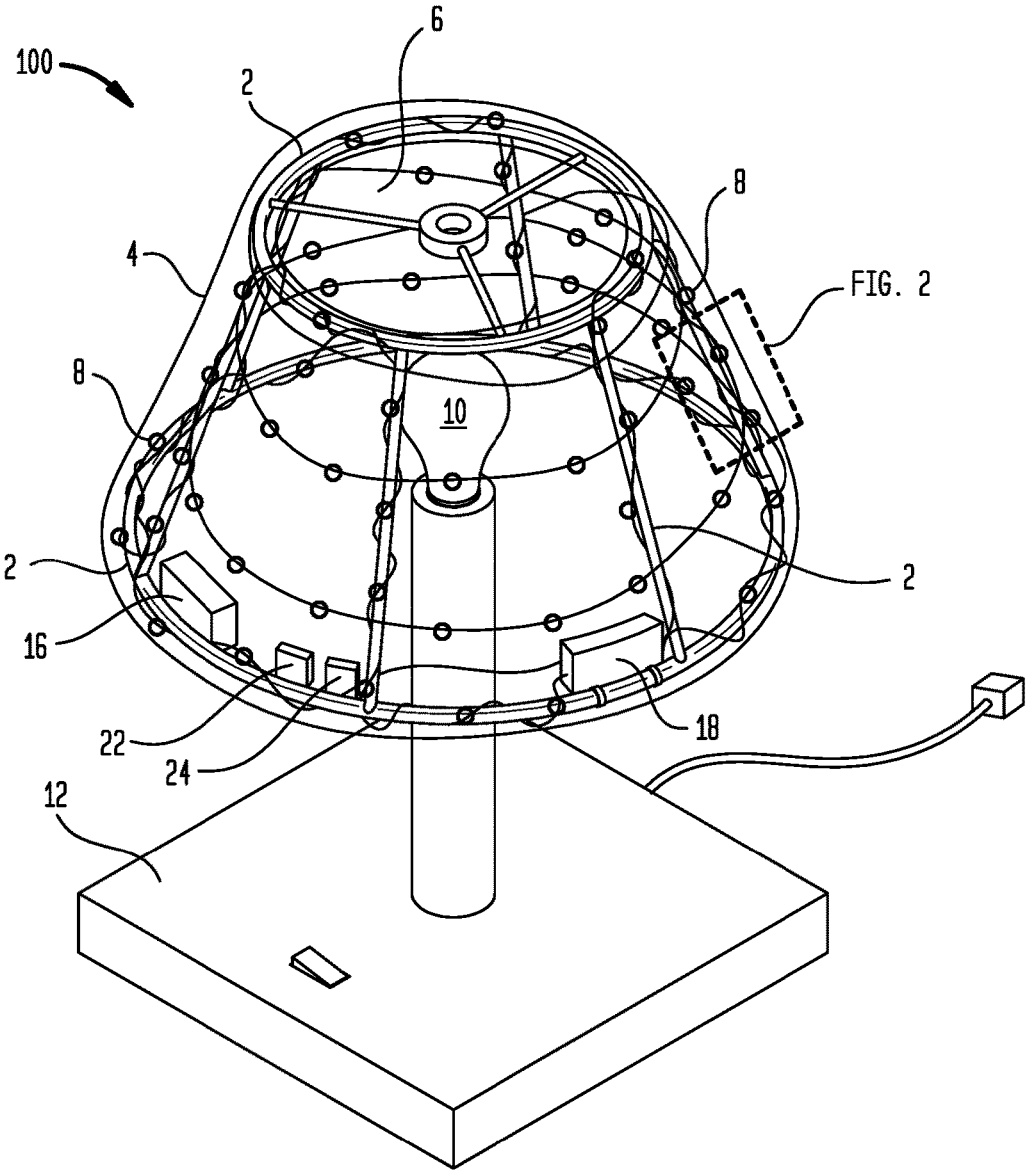
FIG. 1 depicts an isometric view of one non-limiting embodiment of some of the elements of the instant shade assembly.

As used and defined herein, a light can be any type of serial or parallel light source such as a string of LEDs, a string of bulbs, or individual illuminating devices. A light as used herein can be singular or plural.

Referring to FIGS. 1-4, a non-limiting embodiment of a shade assembly 100 is shown. The assembly includes support frame 2. Frame 2 cam be made out of any suitable material such as metal or a non-flammable polymer suitable for use in electrical applications. The frame can be shaped in wide arrangement of geometries which allows for easy replacement of a large number of pre-existing lamp shades with the instant assembly.

The frame 2, includes outer surface 4 and inner surface 6. Lights 8 are disposed between the inner surface and the outer surface although other embodiments are contemplated in which the lights can be mounted on either the inner surface or the outer surface. The lights can be connected to a power source such as battery 16. Lights 8 can be white or colored and configured in any combination thereof. A timer, 18 is connected to the frame. The timer can be wired to function to control the lights. The battery can supply power to the timer or the lights or both. The timer can include a separate battery. It will be appreciated that an ordinary person of skill in the art could determine the wiring required to perform these functions.

FIG. 1 also depicts lamp 12 having a light bulb connected to a standard AC power source. It will be appreciated that the instant invention can be adapted to function with a wide range of lamps and other such devices.

Figure 2:
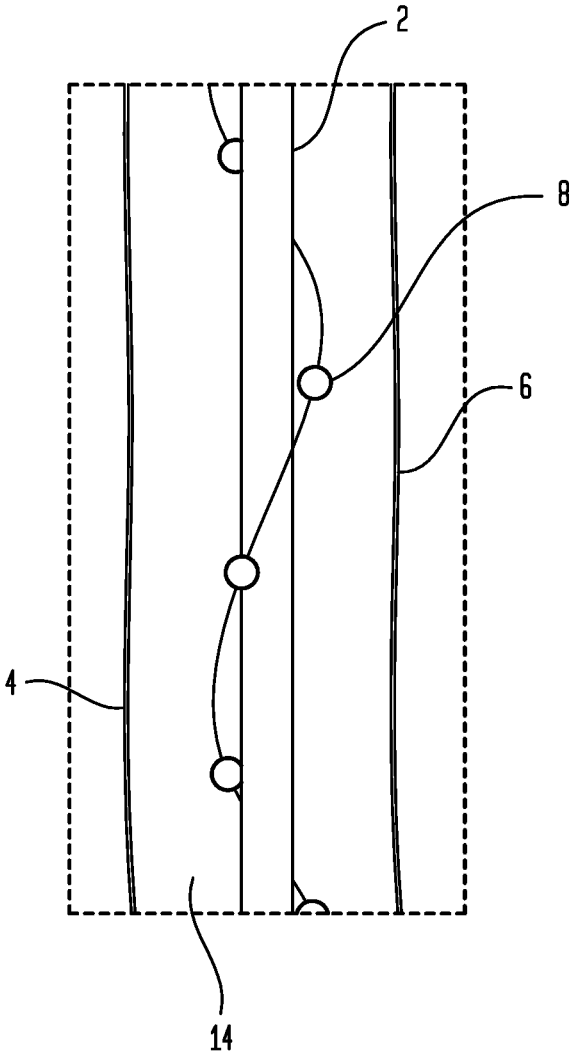
FIG. 2 depicts a cross-sectional view of one non-limiting embodiment of a portion of the instant shade assembly.

FIG. 2 depicts a particular embodiment in which lights 8 are disposed between inner and outer surfaces, 6, 4, of shade 100 within gap 14. In this embodiment, the lights are connected to and supported by support frame 2, which can support the material of shade 100 and the lights.

Figure 3:
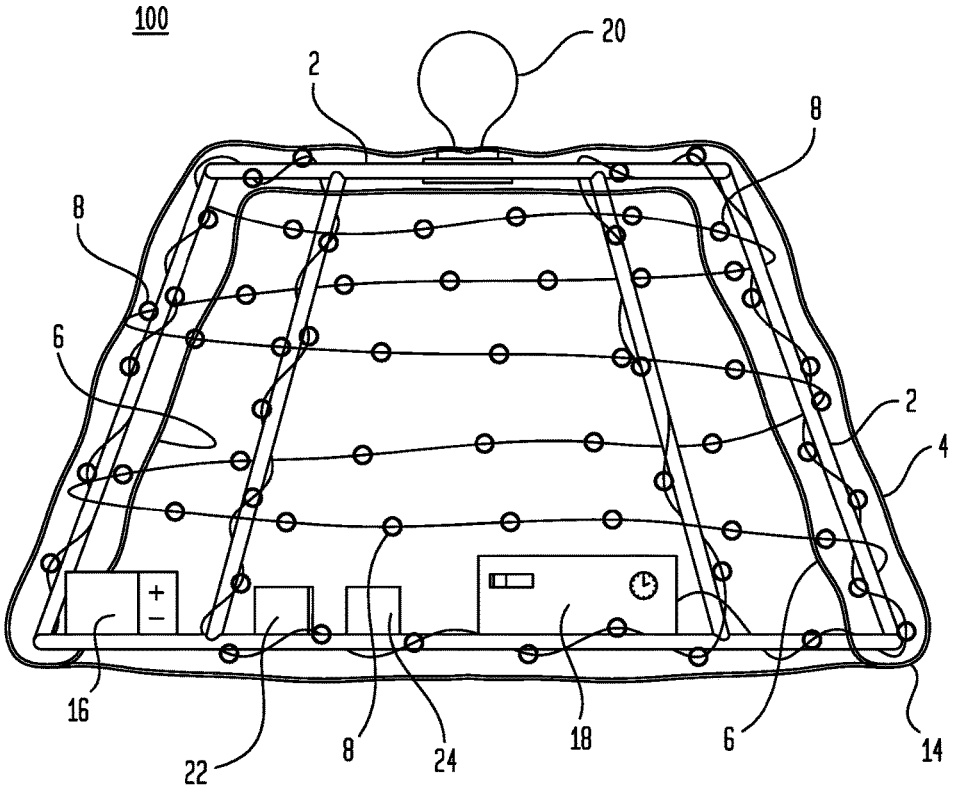
FIG. 3 depicts an isometric view of one non-limiting embodiment of some of the elements of the instant shade assembly.

Referring to FIG. 3 support frame 2, shaped as a lamp shade, includes outer surface 4 and inner surface 6 having gap 14 disposed there between. Gap 14 encompasses lights 8 which may be disposed in gap 14 on frame 2.

In this embodiment, the assembly includes battery 16 for providing power to lights 8 and timer 18 for setting the lights, on, off, or according to a programmed schedule. The timer can also be configured to illuminate the lights in various patterns or colors that may be desirable for then end user. For example, the timer can be configured to blink red light for use as an emergency lantern. The lights, timer, and battery are arranged in a circuit accordingly. The timer 18 can include a separate battery of can be powered by battery 16.

In this embodiment, the assembly includes finial 20. Finial 20 is connected to frame 2 such the it can be utilized to attached the assembly 200 to a standard lamp (not shown) and can act as a handle to carry the shade assembly to any convenient location when it is detached from an existing lamp. The finial allows for easy detachment and attachment to an existing lamp, for example, using standard threaded connections.

Further, the device 100, can include one or more motion sensors 22. The sensors can be used to detect motion and illuminate the assembly. Such motion sensors will be known to a person of ordinary skill in the art. For example, in use as a night light or a crime prevention device.

Figure 4:
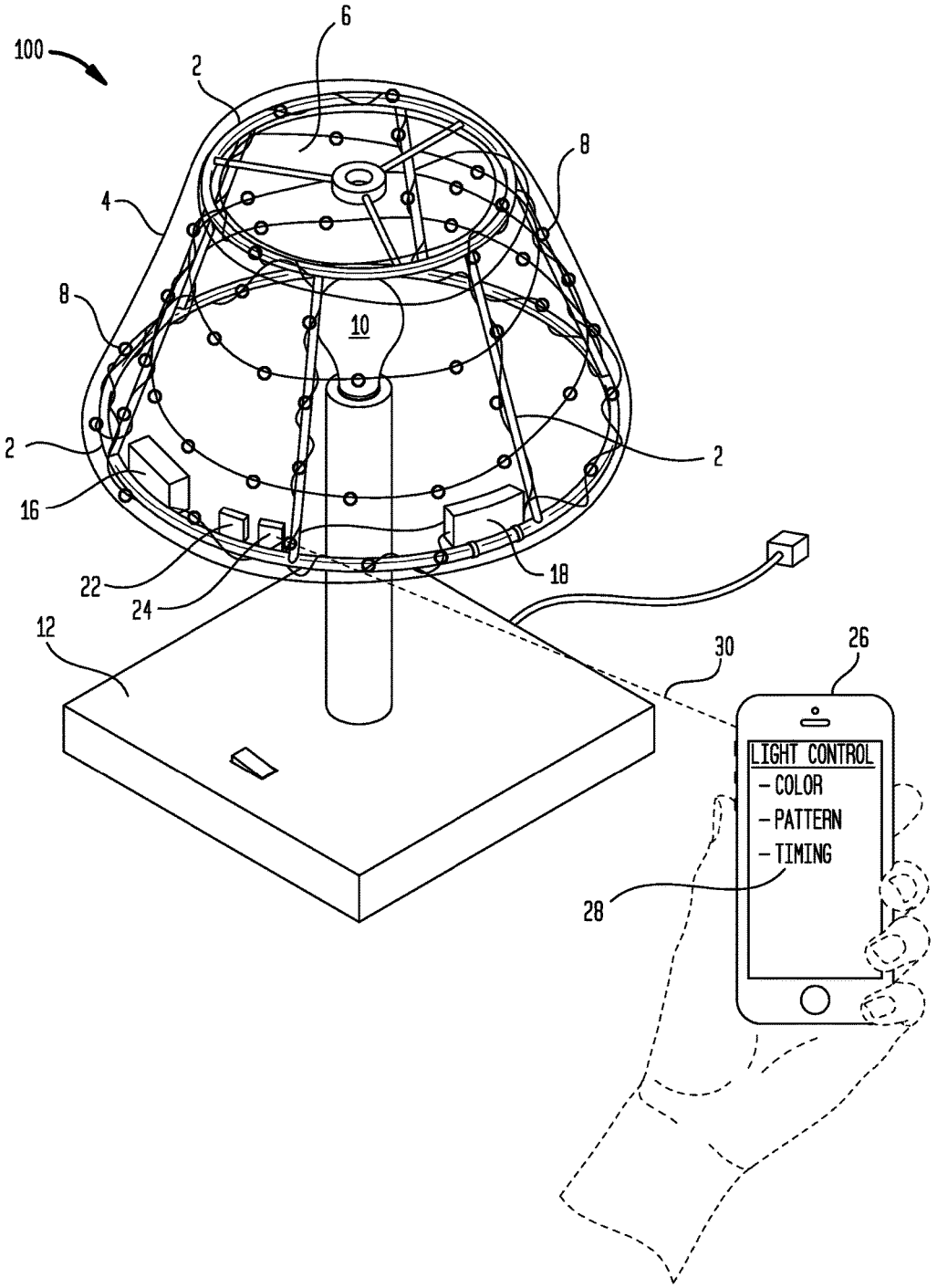
FIG. 4 depicts an isometric view of one non-limiting embodiment of some of the elements of the instant shade assembly.

As shown in FIG. 4, the device can include additional hardware, such as a wireless transceiver 24, which can be paired with a smart device 26 such as a smart cell phone. The cell phone can include an application 28 which can be used to control, for example, the illumination pattern, brightness, or color of the lights via a Wi-Fi link 30.

Although the invention herein has been described with reference to particular embodiments, it is to be understood that these embodiments are merely illustrative embodiments and that other arrangements may be devised without departing from the spirit and scope of the present invention as defined by the disclosure herein.

What is claimed is:

1. A multifunctional illuminated lamp shade assembly comprising:

a. a frame, said frame being configured to attach to or to detach from a lamp, said frame including an inner surface and an outer surface, said frame including a translucent or a transparent cover, said cover having an outer portion disposed on said outer surface of said frame and an inner portion disposed on said inner portion of said frame;

b. at least one light, said at least one light being disposed on said frame between said inner portion and said outer portion of said cover, wherein said at least one light is intertwined between said inner surface and said outer surface of said frame and between said inner portion and said outer portion of said cover, thereby forming transportable detachable illumination unit;

c. a timer; said timer being connected to said frame; and d. a battery; wherein said battery is electrically connected with said timer or said at least one light to provide power thereto.

2. The assembly of claim 1, further including a motion sensor, said sensor being configured to illuminate said one or more lights when motion is detected.

3. The assembly of claim 2, wherein said motion sensor is an optical or an infrared sensor.

4. The assembly of claim 1, further including a wireless transceiver, said transceiver being pairable with a smart device, wherein said smart device executes a software application for controlling an illumination pattern, a brightness, or a color of said at least one light.

5. The assembly of claim 4, wherein said at least one light can be commanded by said smart device to blink in a plurality of colors or a plurality of patterns.

6. The assembly of claim 1, wherein said at least one light is a plurality of LED lights.

7. The assembly of claim 1, further including said lamp.

8. The assembly of claim 7, further including a wireless transceiver, said transceiver being pairable with a smart device, wherein said smart device executes a software application for controlling an illumination pattern, a brightness, or a color of said plurality of LED lights.

9. The assembly of claim 8, wherein said plurality of LED lights can be wirelessly commanded by said smart device to blink in a plurality of colors or a plurality of patterns.

10. An illuminated lamp shade assembly comprising:

a. a lamp, said lamp including a bulb;

b. a frame, said frame being configured to attach to or to detach from a lamp, said frame including an inner surface and an outer surface, said frame including a translucent or a transparent cover, said cover having an outer portion disposed on said outer surface of said frame and an inner portion disposed on said inner portion of said frame;

c. a finial, said finial for attaching said frame to said lamp;

d. a plurality of LED lights, said plurality of LED lights being disposed on said frame between said inner portion and said outer portion of said cover, wherein said plurality of LED lights is intertwined between said inner surface and said outer surface of said frame and between said inner portion and said outer portion of said cover and around said outer or said inner surface of said frame, thereby forming transportable detachable illumination unit;

e. a timer; said timer being connected to said frame; and f. a battery; said battery being electrically connected to said timer and said plurality of LED lights to provide power thereto.

11. The assembly of claim 10, further including a motion sensor, said sensor being configured to illuminate said at least on light when motion is detected.

12. The assembly of claim 11, wherein said motion sensor is an optical or and infrared sensor.

13. An illuminated lamp shade assembly comprising:

a. a lamp, said lamp including a bulb;

b. a frame, said frame being configured to attach to or to detach from a lamp, said frame including an inner surface and an outer surface, said frame including a translucent or a transparent cover, said cover having an outer portion disposed on said outer surface of said frame and an inner portion disposed on said inner portion of said frame;

c. a finial, said finial for attaching said frame to said lamp;

d. a plurality of lights, said plurality of lights being disposed on said frame between said inner portion and said outer portion of said cover, wherein said plurality of lights is spirally intertwined around said frame between said inner surface and said outer surface of said frame and between said inner portion and said outer portion of said cover and around said outer or said inner surface of said frame, thereby forming transportable detachable illumination unit;

e. a timer; said timer being connected to said frame;

f. a battery; said battery being electrically connected to said timer and said plurality of lights to provide power thereto;

g. an optical or infrared motion sensor, said sensor being configured to illuminate said plurality of lights when motion is detected; and h. a wireless transceiver, said transceiver being pairable with a smart device, wherein said smart device executes a software application for controlling an illumination pattern, a brightness, or a color of said plurality of lights.

* * * * *